US009336931B2

(12) United States Patent
Tsai et al.

(10) Patent No.: US 9,336,931 B2
(45) Date of Patent: May 10, 2016

(54) CHIP RESISTOR

(71) Applicant: YAGEO CORPORATION, Kaohsiung (TW)

(72) Inventors: Dong-Mou Tsai, Kaohsiung (TW); Tsai-Hu Chen, Kaohsiung (TW); Sheng-Li Hsiao, Kaohsiung (TW); Yung-Han Liu, Kaohsiung (TW); Jen-Fu Ho, Kaohsiung (TW)

(73) Assignee: YAGEO CORPORATION, Kaohsiung (TW)

( * ) Notice: Subject to any disclaimer, the term of this patent is extended or adjusted under 35 U.S.C. 154(b) by 94 days.

(21) Appl. No.: 14/298,286

(22) Filed: Jun. 6, 2014

(65) Prior Publication Data

US 2015/0357097 A1 Dec. 10, 2015

(51) Int. Cl.
*H01C 1/012* (2006.01)
*H01C 1/142* (2006.01)

(52) U.S. Cl.
CPC ..... *H01C 1/142* (2013.01); *H01C 1/012* (2013.01)

(58) Field of Classification Search
CPC ..... H01C 1/012; H01C 1/14; H01C 1/142; H01C 1/146; H01C 1/148
USPC ..... 338/307, 309, 313, 327, 328, 332, 314
See application file for complete search history.

(56) References Cited

U.S. PATENT DOCUMENTS 6,153,256 A 11/2000 Kambara et al.
6,242,999 B1 6/2001 Nakayama et al.
6,492,896 B2 12/2002 Yoneda
6,856,234 B2 2/2005 Kuriyama et al.
6,859,133 B2 * 2/2005 Nakanishi ..... H01C 7/003 338/309
6,861,941 B2 3/2005 Kuriyama
6,982,624 B2 1/2006 Saito et al.

(Continued)

FOREIGN PATENT DOCUMENTS

JP 2001326101 11/2001
JP 2003338401 11/2003

(Continued)

OTHER PUBLICATIONS

Office Action and Search Report issued on Feb. 11, 2015 by Taiwan Patent Office for the corresponding TW Patent Application No. 102148245.

(Continued)

*Primary Examiner* — Kyung Lee
(74) *Attorney, Agent, or Firm* — WPAT, P.C., Intellectual Property Attorneys; Anthony King

(57) ABSTRACT

The disclosure provides a chip resistor including: a substrate, two first electrodes, two second electrodes, a resistive layer, at least one protection layer and at least one coating layer. The protection layer covers part of the two first electrodes, and includes at least two overlay sides and at least one overlay plane. The coating layer covers the at least two overlay sides, the at least one overlay plane, and part of the two first electrodes and the two second electrodes. The chip resistor uses the two overlay sides and the overplay plane to extend a distance between the two first electrodes and the outside. Therefore, it is difficult for the airborne sulfur, sulfides and sulfur-containing compounds to enter and react with the two first electrodes. Thus, the chip resistor can resist corrosion of harmful substances such as sulfur, sulfides and sulfur-containing compounds or halogens on the electrodes.

11 Claims, 4 Drawing Sheets

(56) References Cited

U.S. PATENT DOCUMENTS

| | | | | |
|---|---|---|---|---|
| 7,098,768 | B2 | 8/2006 | Doi | |
| 7,982,582 | B2 | 7/2011 | Belman et al. | |
| 8,035,476 | B2 | 10/2011 | Yang et al. | |
| 8,514,051 | B2 | 8/2013 | Belman et al. | |
| 8,957,756 | B2 | 2/2015 | Belman et al. | |
| 2004/0160303 | A1* | 8/2004 | Kuriyama | H01C 1/142 338/309 |
| 2006/0257672 | A1 | 11/2006 | Horikoshi et al. | |
| 2008/0129443 | A1 | 6/2008 | Tsukada et al. | |
| 2008/0211619 | A1 | 9/2008 | Belman et al. | |
| 2011/0089025 | A1* | 4/2011 | Yang | C23C 14/185 204/192.21 |

FOREIGN PATENT DOCUMENTS

| | | |
|---|---|---|
| JP | 2004186627 | 7/2004 |
| JP | 3665545 | 4/2005 |
| JP | 3867587 | 10/2006 |
| JP | 2006316184 | 11/2006 |
| TW | 434586 | 5/2001 |
| TW | 200540881 | 12/2005 |
| TW | 201303912 | 1/2013 |
| TW | I395232 | 5/2013 |

OTHER PUBLICATIONS

English translation of the Search Report issued on Feb. 11, 2015 by Taiwan Patent Office for the corresponding TW Patent Application No. 102148245.
English abstract translation of TWI395232.
TWI395232 corresponds to U.S. Pat. No. 8,035,476.
English abstract translation of TW 200540881.
English abstract translation of TW 434586.
TW 434586 corresponds to U.S. Pat. No. 6,242,999.
English abstract translation of TW 201303912.
TW 201303912 corresponds to U.S. Pat. No. 7,982,582 and U.S. Pat. No. 8,957,756.
Notice of Allowance issued Aug. 10, 2015 for for the corresponding TW Patent Application No. 102148245.

* cited by examiner

CHIP RESISTOR

BACKGROUND OF THE INVENTION

1. Field of the Invention

The present invention relates to a chip resistor, and in particular, to a sulfur resistant chip resistor.

2. Description of the Related Art

Thick-film and thin-film chip resistors of the conventional surface mount components usually includes resistors, conductors, glass, insulating overcoats and electro-plated terminals. Generally, silver-containing materials are often used as conductor materials, so as to be electrically connected with resistive materials and serve as first electrodes, second electrodes or side electrodes.

SUMMARY OF THE INVENTION

The present disclosure provides a chip resistor. In an embodiment, the chip resistor includes: a substrate, two first electrodes, two second electrodes, a resistive layer, at least one protection layer and at least one coating layer. The substrate has a first surface and a second surface, and the second surface is opposite to the first surface. The two first electrodes are disposed on the first surface. The two second electrodes are disposed on the second surface. The resistive layer is disposed on the first surface and covers part of the two first electrodes. The at least one protection layer is disposed on the resistive layer and covers part of the two first electrodes. The at least one protection layer includes at least two overlay sides and at least one overlay plane. The at least one coating layer covers the at least two overlay sides, the at least one overlay plane, and part of the two first electrodes and the two second electrodes.

The present disclosure provides a chip resistor. In an embodiment, the chip resistor includes: a substrate, two first electrodes, two second electrodes, a resistive layer, at least one protection layer and at least one coating layer. The substrate has a first surface and a second surface, and the second surface is opposite to the first surface. The two first electrodes are disposed on the first surface. The two second electrodes are disposed on the second surface. The resistive layer is disposed on the first surface and covers part of the two first electrodes. The at least one protection layer is disposed on the resistive layer and completely covers the other part of the two first electrodes on the plane. The at least one protection layer includes at least tone overlay side. The at least one coating layer covers the at least one overlay side, and the sides of the two first electrodes and the two second electrodes.

The chip resistor of the present invention uses the two overlay sides and the overplay plane to extend a distance between the two first electrodes and the outside. Therefore, it is difficult for the airborne sulfur, sulfides and sulfur-containing compounds to enter and react with the two first electrodes. Thus, the chip resistor of the present invention can resist corrosion of harmful substances such as sulfur, sulfides and sulfur-containing compounds or halogens on the electrodes.

BRIEF DESCRIPTION OF THE DRAWINGS

The invention will be described according to the appended drawings in which.

DETAILED DESCRIPTION OF THE INVENTION

Figure 1:
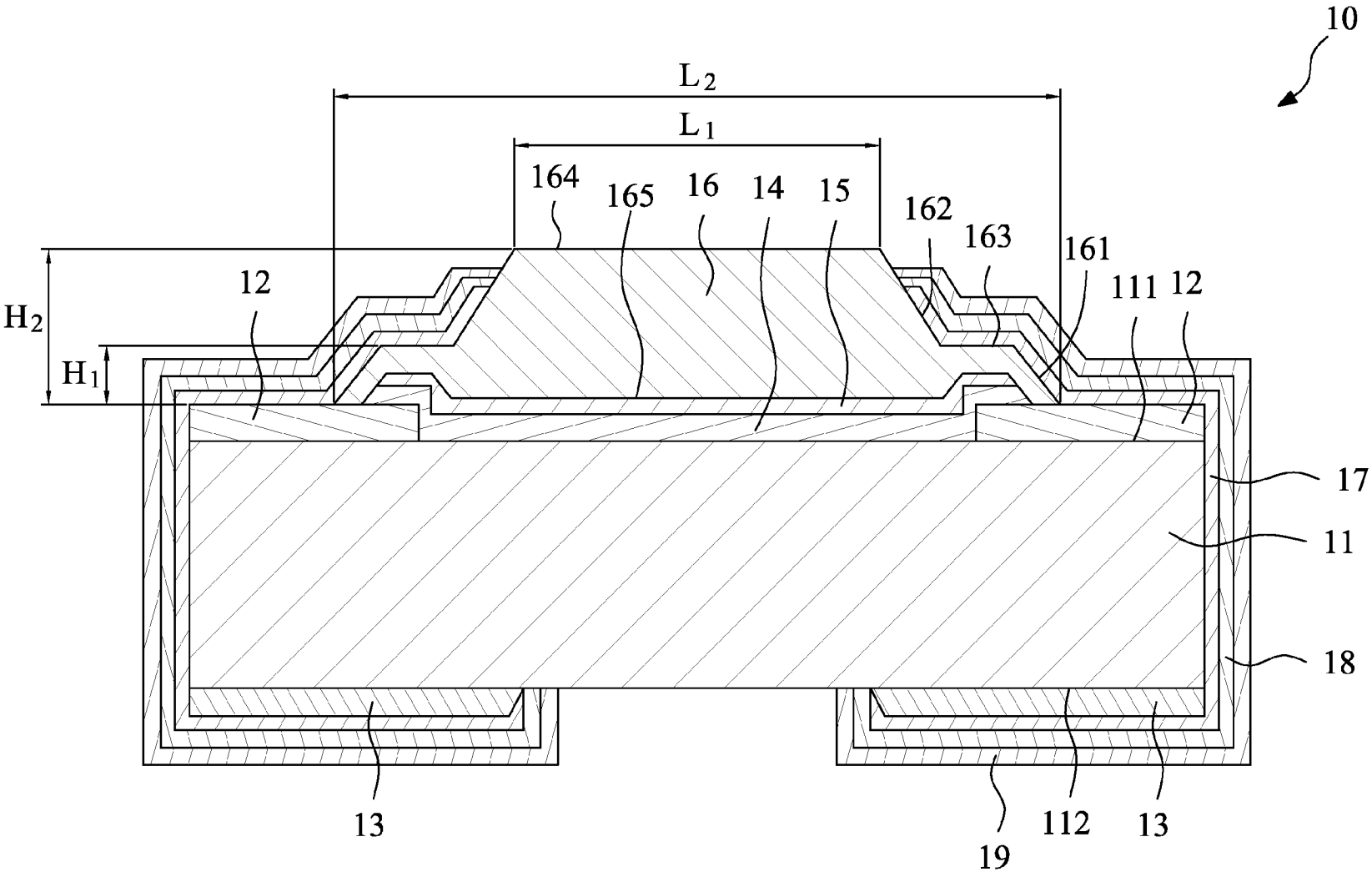
FIG. 1 is a schematic view of a chip resistor according to a first embodiment of the present invention.

Reference numerals may be repeated throughout the embodiments, but this does not necessarily require that feature(s) of one embodiment apply to another embodiment, even if they share the same reference numeral.

FIG. 1 is a schematic view of a chip resistor according to a first embodiment of the present invention. In an embodiment, a chip resistor 10 of the present invention includes: a substrate 11, two first electrodes 12, two second electrodes 13, a resistive layer 14, at least one protection layer 15 and 16, and at least one coating layer 17, 18, and 19. The substrate 11 has a first surface 111 and a second surface 112, and the second surface 112 is opposite to the first surface 111. The two first electrodes 12 are disposed on the first surface 111, and the two first electrodes 12 are separated from each other by a distance. Sides of the two first electrodes 12 are aligned with two sides of the substrate 11 respectively. The two second electrodes 13 are disposed on the second surface 112, and the two second electrodes 13 are separated from each other by a distance. Sides of the two second electrodes 13 are aligned with the two sides of the substrate 11 respectively.

The resistive layer 14 is disposed on the first surface 111 and covers part of the two first electrodes 12, so as to be electrically connected with the two first electrodes 12. The protection layers 15 and 16 are disposed on the resistive layer 14 and cover part of the two first electrodes 12. The at least one protection layer includes at least two overlay sides and at least one overlay plane. In an embodiment, the at least one protection layer includes a first protection layer 15 and a second protection layer 16. The first protection layer 15 is disposed on the resistive layer 14, and the second protection layer 16 is disposed on the first protection layer 15 and covers part of the two first electrodes 12. The second protection layer 16 includes at least two overlay sides 161 and 162 and at least one overlay plane 163. The overlay plane 163 is disposed between the two overlay sides 161 and 162. Corresponding to the overlay plane 163, the two overlay sides 161 and 162 have a tilt angle.

The second protection layer 16 further includes an exposed plane 164, and a thickness H2 from the exposed plane 164 to a bottom 165 of the second protection layer 16 is greater than a thickness H1 from the overlay plane 163 to the bottom 165, to form a convex structure.

In an embodiment, the second protection layer 16 is manufactured with two steps: the first step is that the overlay plane 163 and the overlay side 161 are formed, and the second step is that the exposed plane 164 and the overlay side 162 are formed, and the exposed plane 164 and the overlay side 162 cover part of the overlay plane 163, to form a convex structure.

In another embodiment, the second protection layer 16 is manufactured in a stack manner: first, the overlay plane 163 and the overlay side 161 are manufactured to serve as one layer of the second protection layer 16, and the exposed plane 164 and the overlay side 162 are manufactured to serve as the other layer of the second protection layer 16, and then the layer of the exposed plane 164 and the overlay side 162 is stacked on part of the overlay plane 163, to form a convex structure.

The coating layers 17, 18 and 19 cover the at least two overlay sides 161 and 162, the at least one overlay plane 163, and part of the two first electrodes 12 and the two second electrodes 13. In an embodiment, the at least one coating layer includes a first coating layer 17, a second coating layer 18 and a third coating layer 19. The first coating layer 17 covers the at least two overlay sides 161 and 162, the at least one overlay plane 163, and part of the two first electrodes 12 and the two second electrodes 13. The first coating layer 17 completely covers sides of the two first electrodes 12 and sides of the two second electrodes 13, so as to be electrically connected with the first electrodes 12 and the second electrodes 13. The first coating layer 17 is a conductive material, and preferably, the material is selected from a group including nickel, palladium, platinum, gold, nickel-chromium, nickel-boron, nickel-phosphorus and combinations thereof. The second coating layer 18 covers the first coating layer 17, and preferably, the second coating layer 18 is nickel (Ni). The third coating layer 19 covers the second coating layer 18, and preferably, the third coating layer 19 is tin (Sn).

When the chip resistor is used in harsh environments such as sulfur or halogen-containing atmosphere, because the electrode materials contain silver or copper, under particular temperature and humidity, the silver or copper may have an electrochemical reaction with airborne sulfur, sulfide and sulfur-containing compounds or halogens, so that silver sulfide, copper sulfide, silver bromide, or other products may be produced. The airborne sulfur, sulfides, and sulfur-containing compounds such as hydrogen sulfide, by using diffusion of itself gas, may have an electrochemical reaction at a boundary between an organic protection layer and electrodes. Since a diffusion coefficient of a gas is much greater than that of a solid, sulfur-containing species are diffused inward, and the silver or copper are diffused outward. During the electrochemical reaction, sulfur gas may gradually corrode the silver or copper, causing an increase of a resistance value, and over time, the resistance value is eventually infinite and becomes open-circuited. Flower-like products may be observed from the appearance of the components, which are commonly known as flower of sulfur (FOS).

Generally, the airborne sulfur, sulfides and sulfur-containing compounds are diffused inward from a contact junction between heterogeneous metals, and hence, for example, are usually diffused inward from between the first coating layer 17 and the second protection layer 16. To prevent the chip resistor from being damaged by the FOS or even becoming unusable, a distance between the electrodes and the outside may be increased, so that it is difficult for the airborne sulfur, sulfides and sulfur-containing compounds to enter and react with the electrodes. The chip resistor 10 of the present invention uses the two overlay sides 161 and 162 and the overplay plane 163, so that the coating layers 17, 18, and 19 cover the two overlay sides 161 and 162 and the overplay plane 163, to extend a distance between the two first electrodes 12 and the outside. Therefore, it is difficult for the airborne sulfur, sulfides and sulfur-containing compounds to enter and react with the two first electrodes 12. In an embodiment, the length of the two overlay sides 161 and 162 and the overplay plane 163 is ½ (L2−L1), which is about 0.1 mm. Moreover, the convex structure formed by the two overlay sides 161 and 162 and the overplay plane 163 generates a height difference, so that it is further difficult for the airborne sulfur, sulfides and sulfur-containing compounds to enter and react with the electrodes. Thus, the chip resistor 10 of the present invention can resist corrosion of harmful substances such as sulfur, sulfides and sulfur-containing compounds or halogens on the electrodes.

Furthermore, the chip resistor 10 of the present invention uses the convex structure formed by the two overlay sides 161 and 162 and the overplay plane 163, which has highly compatible in the process, is conducive to mass production and can reduce the manufacturing cost.

Figure 2:
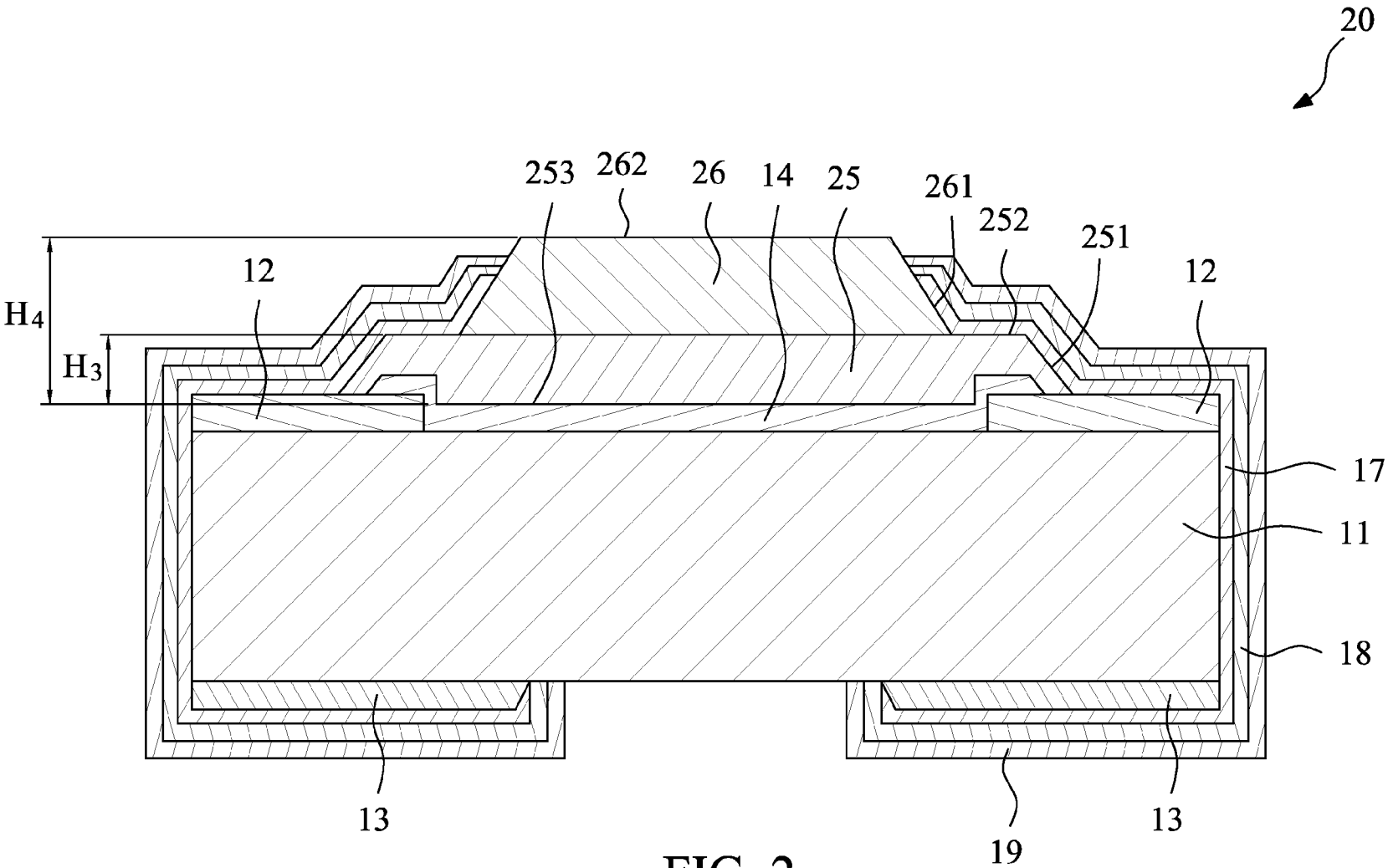
FIG. 2 is a schematic view of a chip resistor according to a second embodiment of the present invention.

FIG. 2 is a schematic view of a chip resistor according to a second embodiment of the present invention. Components in the second embodiment the same as those in the first embodiment are assigned with the same reference numerals. The difference between the second embodiment and the first embodiment of the present invention lies in that: the first protection layer 25 of the chip resistor 20 according to the second embodiment is disposed on the resistive layer 14 and covers part of the two first electrodes 12. The first protection layer 25 includes at least one overlay side 251 and at least one overlay plane 252. The second protection layer 26 is disposed on the first protection layer 25, and the second protection layer 26 includes at least one overlay side 261. The second protection layer 26 further includes an exposed layer 262, and a thickness H4 from the exposed plane 262 to a bottom 253 of the first protection layer 25 is greater than a thickness H3 from the overlay plane 252 of the first protection layer 25 to the bottom 253 of the first protection layer 25. Therefore, the chip resistor 20 of the second embodiment can achieve the above effects of the chip resistor 10 of the first embodiment.

Figure 3:
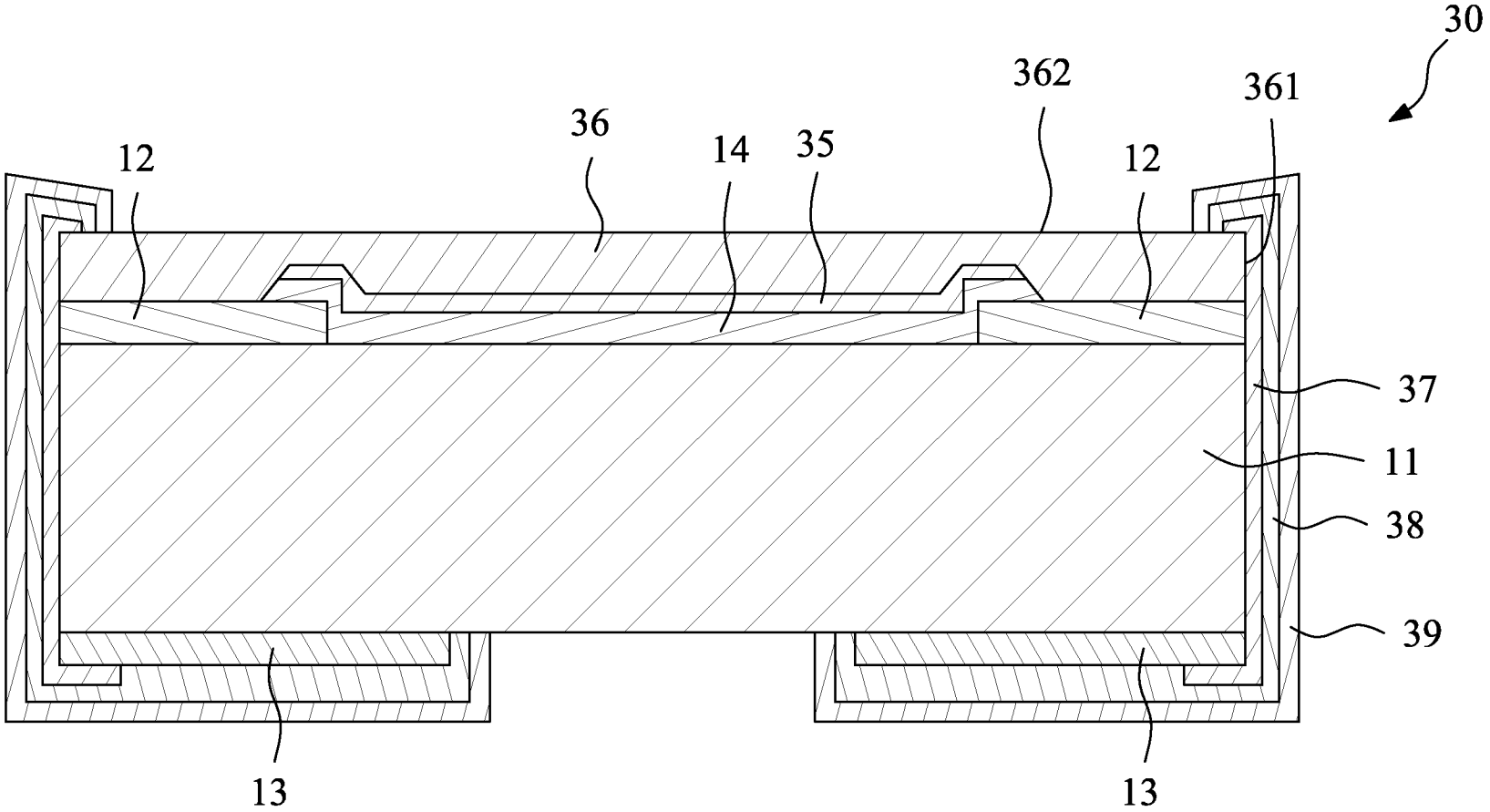
FIG. 3 is a schematic view of a chip resistor according to a third embodiment of the present invention.

FIG. 3 is a schematic view of a chip resistor according to a third embodiment of the present invention. Components in the third embodiment the same as those in the first embodiment are assigned with the same reference numerals. The difference between the third embodiment and the first embodiment of the present invention lies in that: the protection layers 35 and 36 of the chip resistor 30 according to the third embodiment are disposed on the resistive layer 14 and completely covers the other part of the two first electrodes 12 on the plane, and the at least one protection layer includes at least one overlay side. That is, The resistive layer 14 covers part of the two first electrodes 12, and the protection layers 35 and 36 completely covers the other part of the two first electrodes 12 on the plane. The chip resistor 30 includes a first protection layer 35 and a second protection layer 36. The first protection layer 35 is disposed on the resistive layer 14. The second protection layer 36 is disposed on the first protection layer 35 and completely covers the other part of the two first electrodes 12 on the plane, but does not cover sides of the two first electrodes 12. The second protection layer 36 includes at least one overlay side 361 and an exposed plane 362.

The coating layers 37, 38, and 39 of the chip resistor 30 cover the at least one overlay side 361, the sides of the two first electrodes 12, and the two second electrodes 13. The at least one coating layer includes a first coating layer 37, a second coating layer 38 and a third coating layer 39. The first coating layer 37 covers part of the exposed plane 362, the at least one overlay side 361, the sides of the two first electrodes 12, sides of the two second electrodes 13, and part of the two second electrodes 13. The second coating layer 38 covers the first coating layer 37 and part of the two second electrodes 13. The third coating layer 39 covers the second coating layer 38.

The chip resistor 30 of the present invention uses the second protection layer 36 to completely cover the other part of the two first electrodes 12 on the plane, and the coating layers 37, 38, and 39 cover the overlay side 361 and the sides of the two first electrodes 12, so that it is difficult for the airborne sulfur, sulfides and sulfur-containing compounds to enter and react with the electrodes. Hence, the chip resistor 30 of the present invention can resist corrosion of harmful substances such as sulfur, sulfides and sulfur-containing compounds or halogens on the electrodes.

Figure 4:
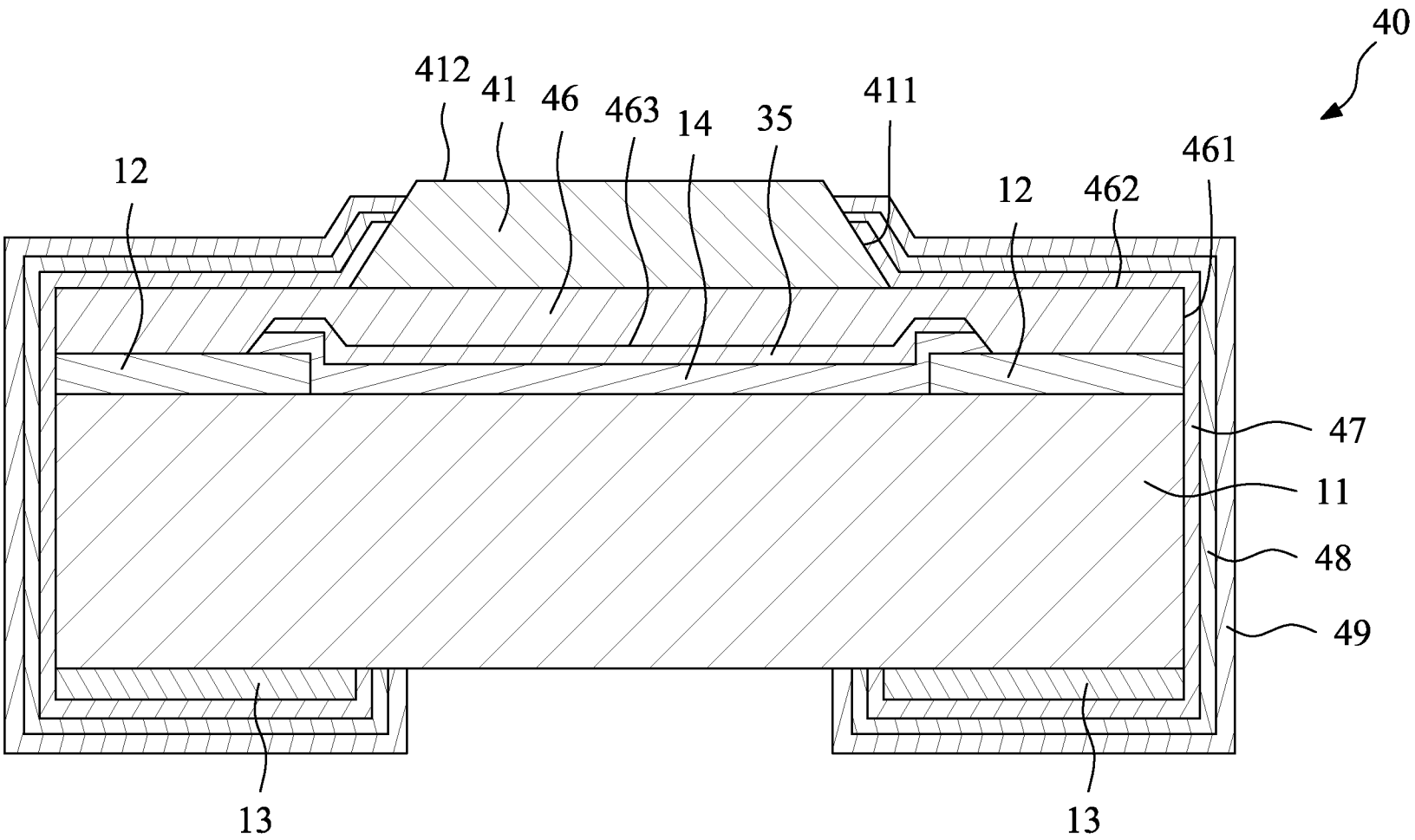
FIG. 4 is a schematic view of a chip resistor according to a fourth embodiment of the present invention.

FIG. 4 is a schematic view of a chip resistor according to a fourth embodiment of the present invention. Components in the fourth embodiment the same as those in the third embodiment are assigned with the same reference numerals. The difference between the fourth embodiment and the third embodiment of the present invention lies in that: the chip resistor 40 of the fourth embodiment includes a third protection layer 41 disposed on the second protection layer 46. The third protection layer 41 includes at least one overlay side 411, and the second protection layer 46 includes at least one overlay side 461 and at least one overlay plane 462.

The at least one coating layer covers the at least one overlay side and the at least one overlay plane of the second protection layer, and the at least one overlay side of the third protection layer. In an embodiment, the at least one coating layer includes a first coating layer 47, a second coating layer 48, and a third coating layer 49. The first coating layer 47 covers the overlay side 411 of the third protection layer 41, the overlay plane 462 and the at least one overlay side 461 of the second protection layer 46, sides of the two first electrodes 12, and the two second electrodes 13. The second coating layer 48 covers the first coating layer 47. The third coating layer 49 covers the second coating layer 48.

The third protection layer 41 further includes an exposed plane 412, and a thickness from the exposed plane 412 to a bottom 463 of the second protection layer 46 is greater than a thickness from the overlay plane 462 of the second protection layer 46 to the bottom 463 of the second protection layer 46, thereby also forming a convex structure.

Therefore, the chip resistor 40 of the present invention uses the overlay side 411 of the third protection layer 41 and the overlay side 461 and the overlay plane 462 of the second protection layer 46, to extend a distance between the two first electrodes 12 and the outside, so that it is difficult for the airborne sulfur, sulfides and sulfur-containing compounds to enter and react with the two first electrodes 12. Hence, the chip resistor 40 of the present invention can resist corrosion of harmful substances such as sulfur, sulfides and sulfur-containing compounds or halogens on the electrodes.

While several embodiments of the present disclosure have been illustrated and described, various modifications and improvements can be made by those skilled in the art. The embodiments of the present disclosure are therefore described in an illustrative but not in a restrictive sense. It is intended that the present disclosure should not be limited to the particular forms as illustrated and that all modifications which maintain the spirit and scope of the present disclosure are within the scope defined in the appended claims.

What is claimed is:

1. A chip resistor, comprising:

a substrate, having a first surface and a second surface, and the second surface being opposite to the first surface;

two first electrodes, disposed on the first surface;

two second electrodes, disposed on the second surface;

a resistive layer, disposed on the first surface and covering part of the two first electrodes;

at least one protection layer, disposed on the resistive layer and covering part of the two first electrodes, and one side of the at least one protection layer comprising at least two overlay sides and at least one overlay plane, wherein the at least one overlay plane is disposed between the at least two overlay sides, and wherein the at least one protection layer is formed as a convex structure; and at least one coating layer, covering the at least two overlay sides, the at least one overlay plane, and part of the two first electrodes and the two second electrodes.

2. The chip resistor according to claim 1, wherein the at least one protection layer comprises a first protection layer and a second protection layer, the first protection layer is disposed on the resistive layer, and the second protection layer is disposed on the first protection layer, the second protection layer comprises at least two overlay sides and at least one overlay plane.

3. The chip resistor according to claim 2, wherein the second protection layer further comprises an exposed plane, and a thickness from the exposed plane to a bottom of the second protection layer is greater than a thickness from the overlay plane to the bottom.

4. The chip resistor according to claim 1, wherein the at least one protection layer comprises a first protection layer and a second protection layer; the first protection layer is disposed on the resistive layer, and the first protection layer comprises at least one overlay side and at least one overlay plane; the second protection layer is disposed on the first protection layer, and the second protection layer comprises at least one overlay side.

5. The chip resistor according to claim 4, wherein the second protection layer further comprises an exposed layer, and a thickness from the exposed plane to a bottom of the first protection layer is greater than a thickness from the overlay plane of the first protection layer to the bottom of the first protection layer.

6. The chip resistor according to claim 1, wherein the at least one coating layer comprises a first coating layer, a second coating layer and a third coating layer; the first coating layer covers the at least two overlay sides, the at least one overlay plane, and part of the two first electrodes and the two second electrodes, the second coating layer covers the first coating layer, and the third coating layer covers the second coating layer.

7. A chip resistor, comprising:

a substrate, having a first surface and a second surface, and the second surface being opposite to the first surface;

two first electrodes, disposed on the first surface;

two second electrodes, disposed on the second surface;

a resistive layer, disposed on the first surface and covering part of the two first electrodes;

at least one protection layer, disposed on the resistive layer and completely covering the other part of the two first electrodes on the plane, and the at least one protection layer comprising at least one overlay side; and at least one coating layer, covering the at least one overlay side, and the sides of the two first electrodes and the two second electrodes;

wherein the at least one protection layer comprises a first protection layer and a second protection layer, the first protection layer is disposed on the resistive layer, the second protection layer is disposed on the first protection layer and completely covers the other part of the two first electrodes on the plane, the second protection layer comprises at least one overlay side and an exposed plane.

8. The chip resistor according to claim 7, wherein the at least one coating layer comprises a first coating layer, a second coating layer and a third coating layer; the first coating layer covers part of the exposed plane, the at least one overlay side, the sides of the two first electrodes, sides of the two second electrodes, and part of the two second electrodes, the second coating layer covers the first coating layer, the third coating layer covers the second coating layer.

9. A chip resistor, comprising:

a substrate, having a first surface and a second surface, and the second surface being opposite to the first surface;

two first electrodes, disposed on the first surface;

two second electrodes, disposed on the second surface;

a resistive layer, disposed on the first surface and covering part of the two first electrodes;

at least one protection layer, disposed on the resistive layer and completely covering the other part of the two first electrodes on the plane, and the at least one protection layer comprising at least one overlay side; and at least one coating layer, covering the at least one overlay side, and the sides of the two first electrodes and the two second electrodes, wherein the at least one protection layer comprises a first protection layer, a second protection layer and a third protection layer; the first protection layer is disposed on the resistive layer; the second protection layer is disposed on the first protection layer and completely covers the other part of the two first electrodes on the plane, the second protection layer comprises at least one overlay side and at least one overlay plane; the third protection layer is disposed on the second protection layer, and the third protection layer comprises at least one overlay side.

10. The chip resistor according to claim 9, wherein the at least one coating layer comprises a first coating layer, a second coating layer, and a third coating layer; the first coating layer covers the overlay side of the third protection layer, the at least one overlay plane and the at least one overlay side of the second protection layer, sides of the two first electrodes, and the two second electrodes; the second coating layer covers the first coating layer; and the third coating layer covers the second coating layer.

11. The chip resistor according to claim 9, wherein the third protection layer further comprises an exposed plane, and a thickness from the exposed plane to a bottom of the second protection layer is greater than a thickness from the overlay plane of the second protection layer to the bottom of the second protection layer.

* * * * *